United States Patent [19]

Tesoro

[11] 4,296,655

[45] Oct. 27, 1981

[54] SLIP JOINT PLIERS

[76] Inventor: Joseph Tesoro, 9 Dade Rd., New City, N.Y. 10956

[21] Appl. No.: 149,043

[22] Filed: May 12, 1980

[51] Int. Cl.[3] ..... B25B 7/04

[52] U.S. Cl. ..... 81/405; 81/407; 81/410 R; 81/412

[58] Field of Search ..... 81/394, 405, 407, 408, 81/409, 410 R, 410 S, 411, 412

[56] References Cited

FOREIGN PATENT DOCUMENTS 112516 11/1944 Sweden ..... 81/412

10112 of 1912 United Kingdom ..... 81/412

241594 10/1925 United Kingdom ..... 81/412

*Primary Examiner*—James L. Jones, Jr.

*Attorney, Agent, or Firm*—William T. Hough

[57] ABSTRACT

In a preferred embodiment, slip joint pliers have a push-button which moves transversely through the adjacent bodies of the pivot portions of the pliers members, to release intermittently one of the plier members to permit a pivot element to slide from one pivot position to an alternate pivot position in the other remaining pliers member, by moving axially an enlarged portion of the pivot element to allow the movement to the alternate pivot position before returning the enlaged portion to the normal pivot location.

4 Claims, 4 Drawing Figures

SLIP JOINT PLIERS

This invention is directed to an improved variety of slip joint pliers.

BACKGROUND TO THE INVENTION

Prior to this invention, there have existed no slip joint pliers satisfactory or suitable for use by the typical mechanic such as a garage mechanic for working on motors, or the plumber in use in plumbing activities, for example. In order to be suitable for use in such trades, the pliers must be substantially free of cumbersome parts and construction, and must be easily adjustable. Also there must be security against accidental intermittent release of the mechanism in order to avoid loss of time as well as to avoid potential injury by unexpected release. This is particularly significant in these noted trades where working space is often very small and where accordingly many adjacent objects are apt to be striking the release mechanism of the pliers during their use. Accordingly, the pliers of U.S. Pat. No. 1,003,978 having a side-mounted lever arm for inserting and withdrawing a lock-pin clearly is not a suitable instrument nor tool for adequate use by automobile mechanics and plumbers for reasons stated above. While the mechanism of the pliers of U.S. Pat. No. 1,410,866 is not unduly cumbersome, to change from one to another position requires the prolonged time-consuming procedure of total removal of the small pin and reinsertion of it, removing the catch before removal of the pin and replacing the catch after reinsertion of the pin. Additionally, the hands of mechanics are often soiled and greasy and not most suitable for the handling of a small pin precisely nor carefully nor with ease, with a significantly great possibility that the pin would be dropped and possibly be lost thereby. The pliers of U.S. Pat. No. 1,520,613 having the laterally-movable lever is highly susceptable to the striking of the lever to cause an accidental release, discussed-above. Likewise the locking lever of U.S. Pat. No. 2,811,068 is highly susceptable to being accidentally struck to release the lock mechanism to cause accidental shifting of the pliers jaws relative to their respective pivot points. In addition to the drawbacks noted above, prior slip joint pliers have been of either or both fragile nature and complicated construction.

SUMMARY OF THE INVENTION

Accordingly, objects of the invention include the obtaining of a lever on slip joint pliers not readily accidentally releasable.

Another object is to obtain slip joint pliers readily and easily releasable, readjustable, and relockable within a minimum and small period of time and not requiring special skill to do so.

Another object is to obtain slip joint pliers having a novel release and adjustment mechanism with aforementioned one or more advantages.

Other objects become apparent from the preceding and following disclosure.

One or more objects of the invention are obtained by the invention as described hereafter and as illustrated in the accompanying drawings intended to improve understanding of the invention but not intended to limit to the mere illustrative embodiments, the invention including obvious modifications and variations within the spirit of the invention.

In a broad sense, the invention resides in the improvement in a slip joint pliers combination wherein at the area of pivot of one of the lever members of the pliers, there is a plurality of consecutively aligned through-apertures in series and interconnected by narrower through-spaces separating the adjacent consecutively aligned through-spaces. That is to say, the linear distance between opposing spaced-apart walls of the smaller through-spaces is less than the diameter of each of the plurality of consecutively aligned through-spaces. The levers' connecting and pivoting mechanism includes transversely extending pivot shaft portions, one portion being normally mounted through a single through-space of the other lever member and through one of the plurality, and a second portion being intermittently replaceable of the other portion and being of a smaller diameter such that the second portion allows the lever member having the plurality of through-spaces to shift to alternate ones thereof until such time as the one-other portion is returned such that it no longer can be shifted. The one portion thus is of a larger diameter than the smaller through-spaces that connect the plurality. Accordingly, when the larger portion is mounted in place within one of the plurality, the pliers function as ordinary pliers, but alternate positions affording different dimensions between opposing gripping jaws of the two pivoting lever members.

In a preferred embodiment, the pivot mechanism further includes a transversely mounted pin, relative to elongated shapes of the pivoting lever members, movable axially and one of its two opposite ends being in contact with or in pressure communication with the above-noted larger portion of the shiftable pivot mechanism such that upon the applying of pressure through the axially movable pin against the larger portion, the larger portion is moved from the larger through-aperature of the above-noted plurality, and the smaller portion is left therein allowing the lever member having the plurality of holes to shift relative to the pivot mechanism, to an alternate position.

As a further preferred feature, the larger portion of the pivot structure as above-described, is intermittently retainable within the larger hole (or through-aperture) of the plurality. This is more preferably accomplished by the presence of a coil spring mounted and extending transversely of the elongated length of the lever members, pressing the larger portion of the pivot mechanism into a normally-mounted position such that the lever members are non-shiftable relative to one-another in a lateral direction, when in this normally locked state.

In a further preferred embodiment, as to the pivot mechanism described previously above, the smaller portion is non-shiftable axially along its length, and has connection or anchoring mechanism, preferably being female-threaded with washers and nuts mounted on each of opposite ends thereof thereby tying together the two lever members at the pivot points thereof at all times.

Preferably both the small and larger portions above-described of the pivot mechanism are each cylindrical in shape, each having a through-bore; the smaller cylinder is mounted within the bore of the larger. Within a one-end sector of the smaller cylinder, there is provided a slot extending (running) lengthwise of the cylinder, and the above-noted pin is mounted within the smaller cylinder's bore and connected by a connector-pin to the larger cylinder such that when pressure causes the pin to move axially along the smaller cylinder's bore, pressure is transmitted through the connector-pin to the larger cylinder thereby causing the larger cylinder to move also in an axial direction thereby being removed from its normally locked mounted position. The coil spring is biased against the bottom portion of the larger cylinder, thus being returnable of the larger cylinder and the pin to the original positions of a locked state above-described.

When in a locked-state wherein the pliers function in normal fashion, and are during the locked state non-shiftable between alternate positions of the above-noted plurality of through-spaces, the pin that is mounted for axial movement along its length within smaller cylinder's bore, is mounted with one end portion of the pin extending exteriorly exposed, the terminal end thereof serving as preferably a push-button depressible to move the larger cylinder from its locking position and state. When pressure on the button is withdrawn, the coil spring thereupon returns the button to the raised portion of a locked state.

The invention may be better understood by making reference to the accompanying Figures, herein described below.

THE FIGURES

Figure 2:
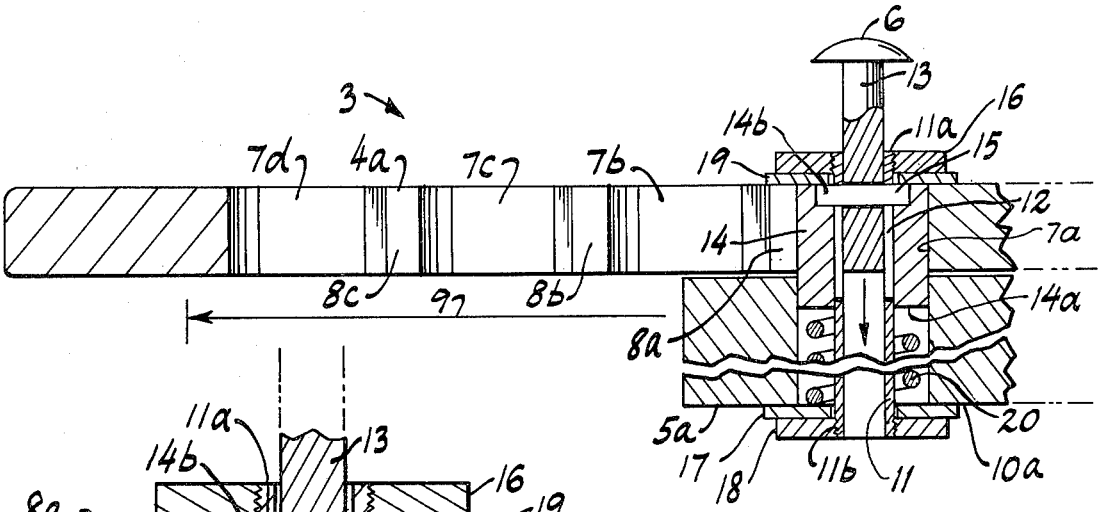
FIG. 2 illustrates an in-part cross-sectional view of the slip joint pliers of FIG. 1, as taken along lines 2—2 of FIG. 1.
Figure 3:
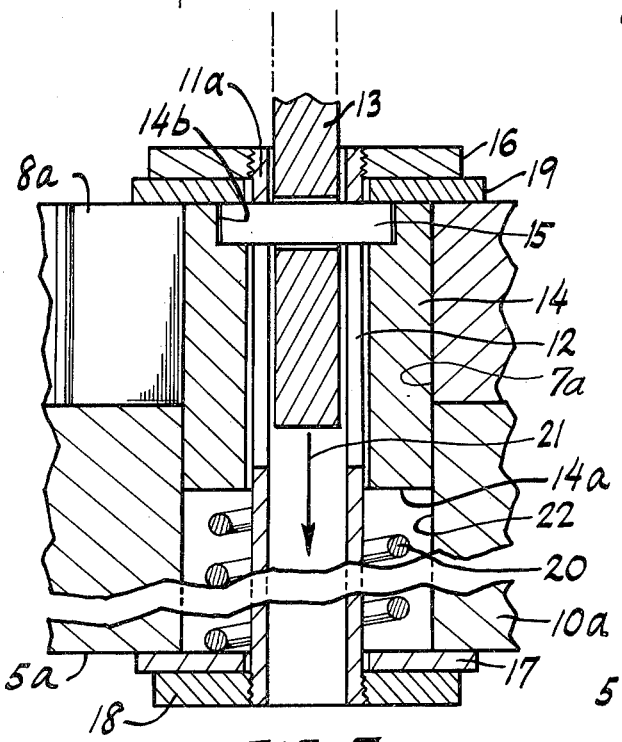

FIG. 3, for improved viewing and illustrates, repeats in enlargement, a portion of the cross-sectional view of FIG. 2.

Figure 3A:
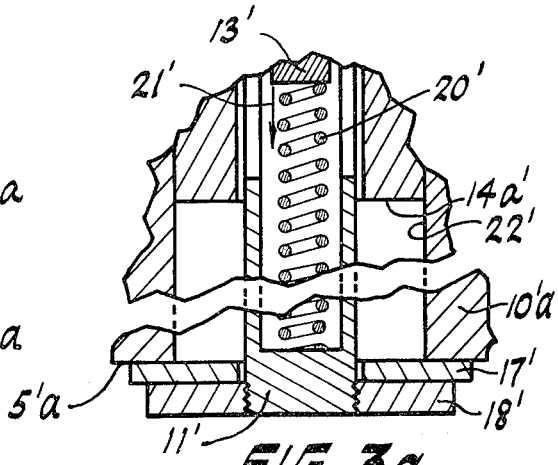

FIG. 3*a* shows an in-part-view cross-section of an alternate embodiment.

Figure 1:
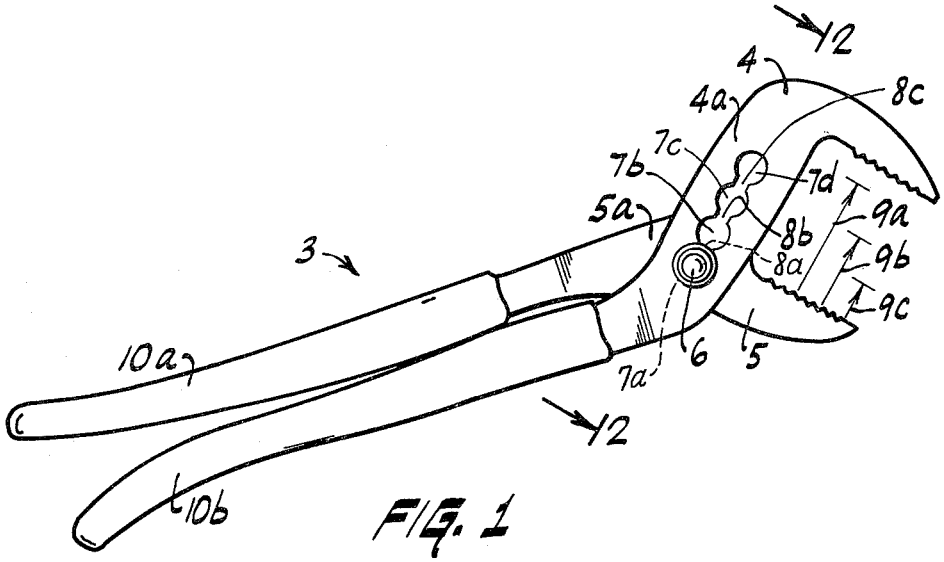
FIG. 1 illustrates a side elevation view of slip joint pliers of a preferred embodiment of this invention, illustrating the plurality of interconnected through-aperatures for alternate pivot positions such that the upper-illustrated lever member may shift relative to the other lever member to and from alternate ones of those alternate pivot positions.

FIGS. 1 through 3 illustrates a common embodiment of the invention, and accordingly all figures should be referred to in the following of the detailed description below.

There is shown slip joint pliers 3 having one lever member 4 and having the other lever member 5, each with a jaw section at one end thereof and with handles 10*a* and 10*b* at the opposite ends thereof, and the two lever members being pivotally mounted at their respective intermediate portions 4*a* and 5*a*.

Within the intermediate portion 5*a* of lever member 5, there is a single pivot-mechanism mounting through-aperture 22. However, within the intermediate portion 4*a* of lever member 4, there are a plurality of consecutive serially-arranged and interconnected through-space apertures 7*a*, 7*b*, 7*c* and 7*d* interconnected by the smaller through-spaces 8*a*, 8*b*, and 8*c*. It is to be understood that the number of alternative adjustment positions, namely the through-space apertures, may vary considerably to more or less as might be desired. It will be noted that the distance between the opposing walls of each through space 8*a*, 8*b*, and 8*c* is much less than the diameters of the respective holes of the plurality 7*a*, 7*b*, 7*c*, and 7*d*. This allow the large cylinder portion 14 of the pivot mechanism to be mounted in an intermittently locked state in any one alternately of the plurality 7*a*, 7*b*, 7*c* and 7*d*, and to be withdrawn or pushed-out-of these lock positions thus leaving the small cylinder portion 11 of a diameter sufficiently smaller than the linear distance above-noted of spaces 8*a*, 8*b*, and 8*c* such that the lever arm 4 may be shifted on the small cylinder portion 11 to different one(s) of the alternate positions of the above-noted plurality. The alternate positions thus allow the jaw of the lever arm 5, for example, to have movement distances of 9*a* or 9*b* or 9*c* from the illustrated position, relative to the lever arm 4 remaining stationary (moving the pivot small cylinder portion 11 to alternate positions).

The pushbutton 6 when depressed causes the pin shaft 13 to move axially of its length downwardly within the bore-space of the small cylinder portion 11. When the pin shaft 13 is caused to move downwardly, and upwardly, as the case may be, it carries with it the connector-pin 15 which is within the recessed depression 14*b* of the larger cylinder portion 14, whereby downward movement of the connector-pin 15 presses the connector-pin 15 downwardly against the larger cylinder portion 14 thereby causing the larger cylinder portion 14 to move downwardly until the top thereof clears (is totally removed from) the lower edge of the lever member 4. Thus, by pressing the button 6, the slip joint pliers can be thereby placed into a slip or shiftable state, preparatory for the movements such as above-noted 9*a* or 9*b* or the like. The connector-pin 15 extends through the slot 12 of the small cylinder portion 11 of the pivot mechanism, and moves downwardly within the slot as the shaft 13 moves in direction 21 as button 6 is pressed downwardly.

The smaller cylinder portion 11 has on opposite ends thereof male threads 11*a* and 11*b*, having mounted thereon the washers 17 and 19 and female-threaded nuts 16 and 18. These nuts thus hold together the pliers' lever members 4 and 5 at their respective pivot positions 4*a* and 5*a*.

The coil spring 20 is biased between the lower washer 17 and the bottom 14*a* of the larger cylinder portion 14 of the pivot mechanism within the through-space 22 of the lever member 5.

Accordingly, the button 6 is returned to its raised position by action of the coil spring 20 when downward pressure is removed from the button 6, thus allowing the larger cylinder portion 14 to be returned by the spring to the locked-state illustrated in the FIGS. 2 and 3.

It is within the scope of the invention to make variations and modifications and substitution of equivalents within the spirit of the illustrated invention, to the extent obvious to a person having ordinary skill in this art. For example, in an alternate embodiment of FIG. 3*a*, the cylinder portion 11' is closed at the bottom end, i.e. only partially drilled-out, and the spring is mounted within the drilled-out space and biases against the solid bottom, biasing upwardly directly against the bottom terminal end of the button's shaft element 13'; this embodiment would be otherwise the same as illustrated in the foregoing FIGS. 1, 2, and 3.

I claim:

1. Slip joint pliers comprising in combination: a first lever member having one end thereof shaped as a plier's first jaw; a second lever member having one end thereof shaped as a plier's second jaw; the respective first and second lever members having respectively first and second handles; the first lever member having a first single through-aperture intermediate between said first jaw and said first handle; the second lever member having a plurality of consecutively aligned through-apertures in series interconnected by a series of consecutive joining-through-apaces; each consecutive joining-through-space being of samller linear distance between opposing spaced-apart walls than diameter of each of said plurality of consecutively aligned through-apertures; and said first single through-aperture and said plurality each having substantially the same diameters; and pivot means mounted axially through said first single through-aperture and at-least one of said plurality, said pivot means being for pivoting said first and second lever members, and the pivot means including first and second portions continuous with one-another and axially-aligned end-to-end with one-another with the first portion being of a diameter greater than said smaller linear distance and lesser than said diameters of each of said plurality and with the second portion being of a diameter smaller than said smaller linear distance, whereby the first portion is retainable against lateral movement when mounted within one of said plurality and whereby the second portion is movable through said consecutive joining-through-spaces alternately when the second portion is mounted within one of said plurality, said first portion being axially movable to and from any one of said plurality and said second portion being mounted within at least one of said plurality when said first portion is removed therefrom whereby said first lever member may be shifted to alternate pivot positions of said plurality of said second lever member when said first portion is removed from a pivot position of one of said plurality, said pivot means including a spring normally spring biasing said first portion into a pivot-mounting position within one of said plurality, said spring being a coil spring, said first and second portions being of cylindrical shapes and with central axially-extending bores and said coil spring being mounted substantially within said bores, the pivot means additionally including a lock pin and the second portion including an axially-extending slot therein with said lock pin locking said pin to said larger portion and said lock pin being mounted through said axially-extending slot.

2. Slip joint pliers of claim 1, in which said second portion is of a length that extends through said single through-aperture and one of said plurality and has threads on each of opposite ends thereof, and a nut being secured to each of said opposite ends on the threads thereof.

3. Slip joint pliers of claim 1, in which said second end is exposed and serves as a depressible button to be axially depressed to move said first portion out of a mounted position and location within one of said plurality.

4. Slip joint pliers comprising in combination: a first lever member having one end thereof shaped as a plier's first jaw; a second lever member having one end thereof shaped as a plier's second jaw; the respective first and second lever members having respectively first and second handles; the first lever member having a first single through-aperture intermediate between said first jaw and said first handle; the second lever member having a plurality of consecutively aligned through-apertures in series interconnected by a series of consecutive joining-through-spaces; each consecutive joining-through-space being of smaller linear distance between opposing spaced-apart walls than diameter of each of said plurality of consecutively aligned through-apertures; and said first single through-aperture and said plurality each having substantially the same diameters; and pivot means mounted axially through said first single through-aperture and at-least one of said plurality, said pivot means being for pivoting said first and second lever members, and the pivot means including first and second portions continuous with one-another and axially-aligned end-to-end with one-another with the first portion being of a diameter greater than said smaller linear distance and lesser than said diameters of each of said plurality, and with the second portion being of a diameter smaller than said smaller linear distance, whereby the first portion is retainable against lateral movement when mounted within one of said plurality and whereby the second portion is movable through said consecutive joining-through-spaces alternately when the second portion is mounted within one of said plurality, said first portion being axially movable to and from any one of said plurality and said second portion being mounted within at least one of said plurality when said first portion is removed therefrom whereby said first lever member may be shifted to alternate pivot positions of said plurality of said second lever member when said first portion is removed from a pivot position of one of said plurality, said first portion including a through-space axial bore and said second portion extending through said first portion and through said first single through-aperture and through one of said plurality, and the pivot means further including securing elements securing said second portion at each of opposite ends such that said first and second lever members are held in flush side-by-side operative relationship at all times.

* * * * *